US007993711B2

(12) United States Patent
DeMoor

(10) Patent No.: US 7,993,711 B2
(45) Date of Patent: Aug. 9, 2011

(54) ENTERTAINMENT SYSTEM FOR A PORTABLE, ATTACHABLE, MULTI-FACETED ONE-PIECE POM PON STRUCTURE WITH SECURED, ADJUSTABLE, OPEN-ENDED FASTENER, OPTIONAL HANDLE STRUCTURES, AND VEHICLE ATTACHMENT CAPABILITY

(76) Inventor: Karen Louise DeMoor, Cedar Rapids, IA (US)

( * ) Notice: Subject to any disclaimer, the term of this patent is extended or adjusted under 35 U.S.C. 154(b) by 162 days.

(21) Appl. No.: 12/157,884

(22) Filed: Jun. 12, 2008

(65) Prior Publication Data

US 2009/0311446 A1 Dec. 17, 2009

Related U.S. Application Data

(60) Provisional application No. 60/934,285, filed on Jun. 12, 2007.

(51) Int. Cl.
*A47G 33/04* (2006.01)
*A47G 35/00* (2006.01)
*B60R 13/00* (2006.01)

(52) U.S. Cl. ..... 428/7; 428/31; 428/542.2

(58) Field of Classification Search ..... 428/7, 31, 428/542.2; 225/257
See application file for complete search history.

(56) References Cited

U.S. PATENT DOCUMENTS

| | | | | | |
|---|---|---|---|---|---|
| 277,609 | A * | 5/1883 | Remington | 16/442 |
| 1,395,033 | A * | 10/1921 | Bowers | 428/4 |
| 1,527,627 | A * | 2/1925 | Walpole | 135/65 |
| 1,611,076 | A * | 12/1926 | Rittner | 473/147 |
| 3,105,243 | A * | 10/1963 | Kampfe et al. | 2/244 |
| 4,590,883 | A * | 5/1986 | Steed et al. | 116/173 |
| 4,786,535 | A * | 11/1988 | Young | 428/4 |
| 4,881,485 | A * | 11/1989 | Feinberg | 116/28 R |
| 4,982,885 | A * | 1/1991 | Severson et al. | 224/675 |
| 5,055,326 | A * | 10/1991 | Whitington | 428/4 |
| 5,079,046 | A * | 1/1992 | Kessler | 428/4 |
| 5,119,979 | A * | 6/1992 | Kallman | 224/250 |
| 5,460,308 | A * | 10/1995 | Hahn | 224/257 |
| 5,508,070 | A * | 4/1996 | DiLapo et al. | 428/24 |
| 5,962,086 | A * | 10/1999 | Offen | 428/4 |
| 5,987,650 | A * | 11/1999 | Carroll | 2/244 |
| 6,138,882 | A * | 10/2000 | Buettner | 224/250 |
| 6,340,507 | B2 * | 1/2002 | Holguin | 428/4 |
| 7,182,483 | B2 * | 2/2007 | Stern et al. | 362/253 |
| 2002/0066462 | A1 * | 6/2002 | Denebeim | 132/275 |
| 2005/0191438 | A1 * | 9/2005 | Tarasuk | 428/7 |

* cited by examiner

*Primary Examiner* — Gordon R Baldwin

(57) ABSTRACT

The present invention is a pompon made of double-sided polyester ribbon strands with permanently attached adjustable open-ended fastener made of hook and loop material that attaches to an outside object, preferably a vehicle, and is portable, durable, color-fade resistant, flame resistant, and washable. The present invention will not shred in the wind, such as a regular plastic pompon. The present invention may be taken off of a vehicle and placed on a person's hand, wrist, arm, etc., and used at a sporting event, and/or hung in a person's home or office when not in use. Other than to represent a sports team, the colors of the present invention may reflect a corporate insignia, or special causes, such as Breast Cancer Awareness, Support Our Troops, etc.

9 Claims, 15 Drawing Sheets

ENTERTAINMENT SYSTEM FOR A PORTABLE, ATTACHABLE, MULTI-FACETED ONE-PIECE POM PON STRUCTURE WITH SECURED, ADJUSTABLE, OPEN-ENDED FASTENER, OPTIONAL HANDLE STRUCTURES, AND VEHICLE ATTACHMENT CAPABILITY

CROSS-REFERENCE TO RELATED APPLICATIONS

Provisional application 60/934285, filing date: Jun. 12, 2007

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Many sports enthusiasts decorate their vehicles as they travel to a sporting event, and some place their regular plastic pom pons out their windows, with the windows rolled up to hold the pompon in place to prevent it from flying out the window. Currently, there is no prior art to show any way to display pompons with team colors on the outside of a vehicle. The present invention introduces a novel way to display a pompon in a secure way on the outside of a vehicle, even while it travels at high speeds down an interstate.

Because of the novel adjustable fastener that is permanently attached to the center gather of the pompom strands, the pompom may be safely and securely placed on the outside of a vehicle, and then removed and attached to a person's wrist, hand, or arm, etc. and used as a regular pompon typically would in a game, and/or it could be taken off the vehicle and displayed at home or the office.

The present invention is durable, and will not shred in the wind while attached to a vehicle, like a regular pompon made out of plastic could. The present invention may also be washed if it incurs dirt from the road, or food stuffs (ie., ketchup, etc) while being used at a game.

The present invention may be used to represent corporate colors and special causes colors, such as Breast Cancer Awareness, and 'Support the Troops' colors, in addition to a sports team colors.

BRIEF SUMMARY OF THE INVENTION

The present invention overcomes the lack of any prior art which allows sports enthusiasts to adorn their vehicles with team, corporate, or special cause colors via the use of a pompon that can be attached to the outside of a vehicle. Because of the specially designed adjustable open-ended fastener, the present invention may be attached to the outside of a vehicle, such as on a door handle, side mirror, back bumper, luggage rack, tow hitch, etc.

The present invention is novel and an improvement from a regular pompon (if used in a vehicle window that is rolled-up to keep the plastic pom from flying out the window), because it is made of durable ribbon material that will not shred or fray in the wind; also, the colors in the polyester ribbon material are fade resistant; and the present invention, both ribbon strands, and fastener may be washable if it becomes dirty from debris on the road or while being used at a game.

Figure 1:
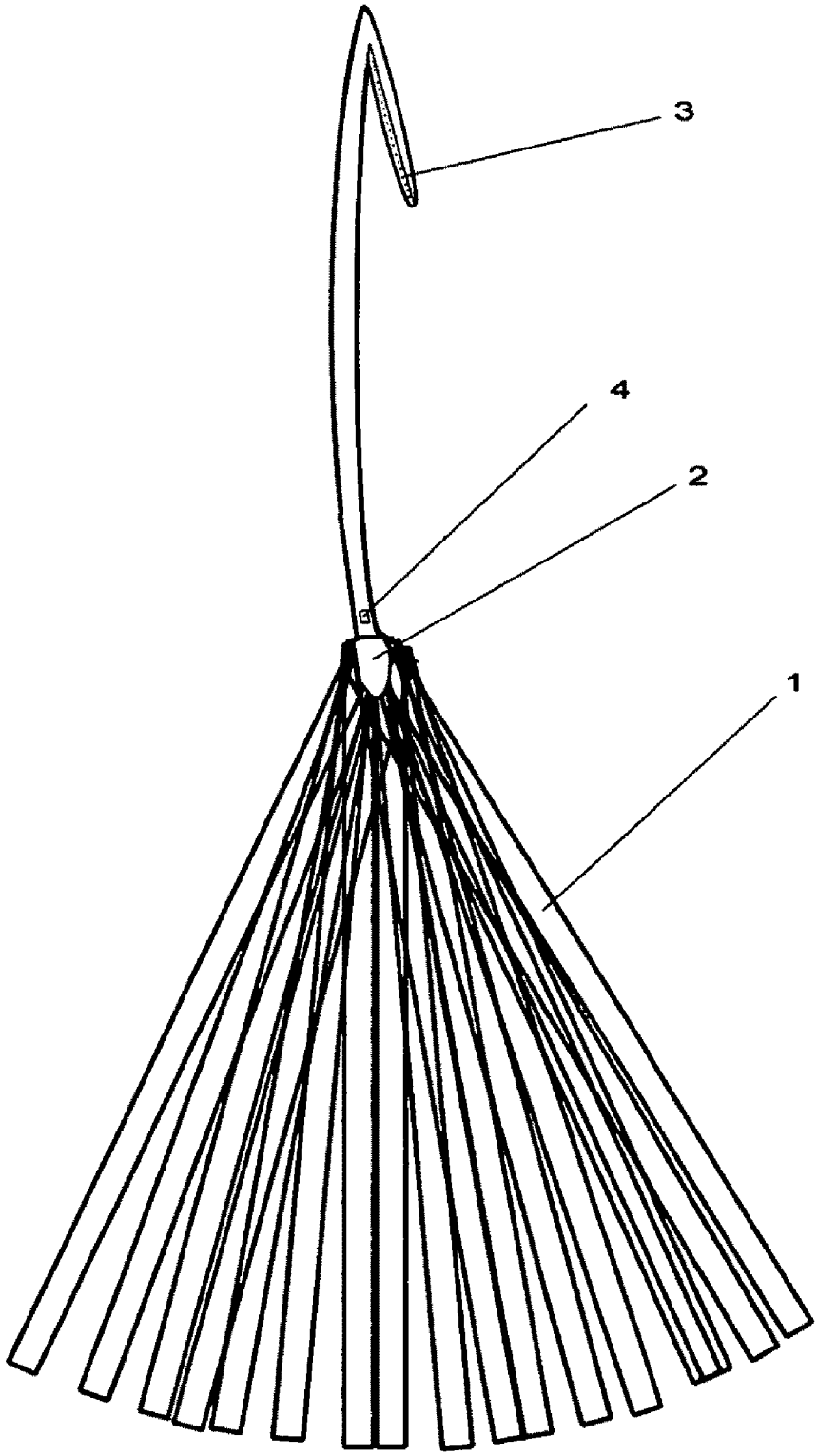
FIG. 1 depicts the present invention with pom pon streamers 1, with one end of the one piece hook and loop fastener securely attached to the middle of the gathered streamers with loop 2 side of fastener showing. An opening 4 is visible where the second end of the hook 3 and loop fastener will thread-through, for attachment, adjustability, and stability purposes.
Figure 2:
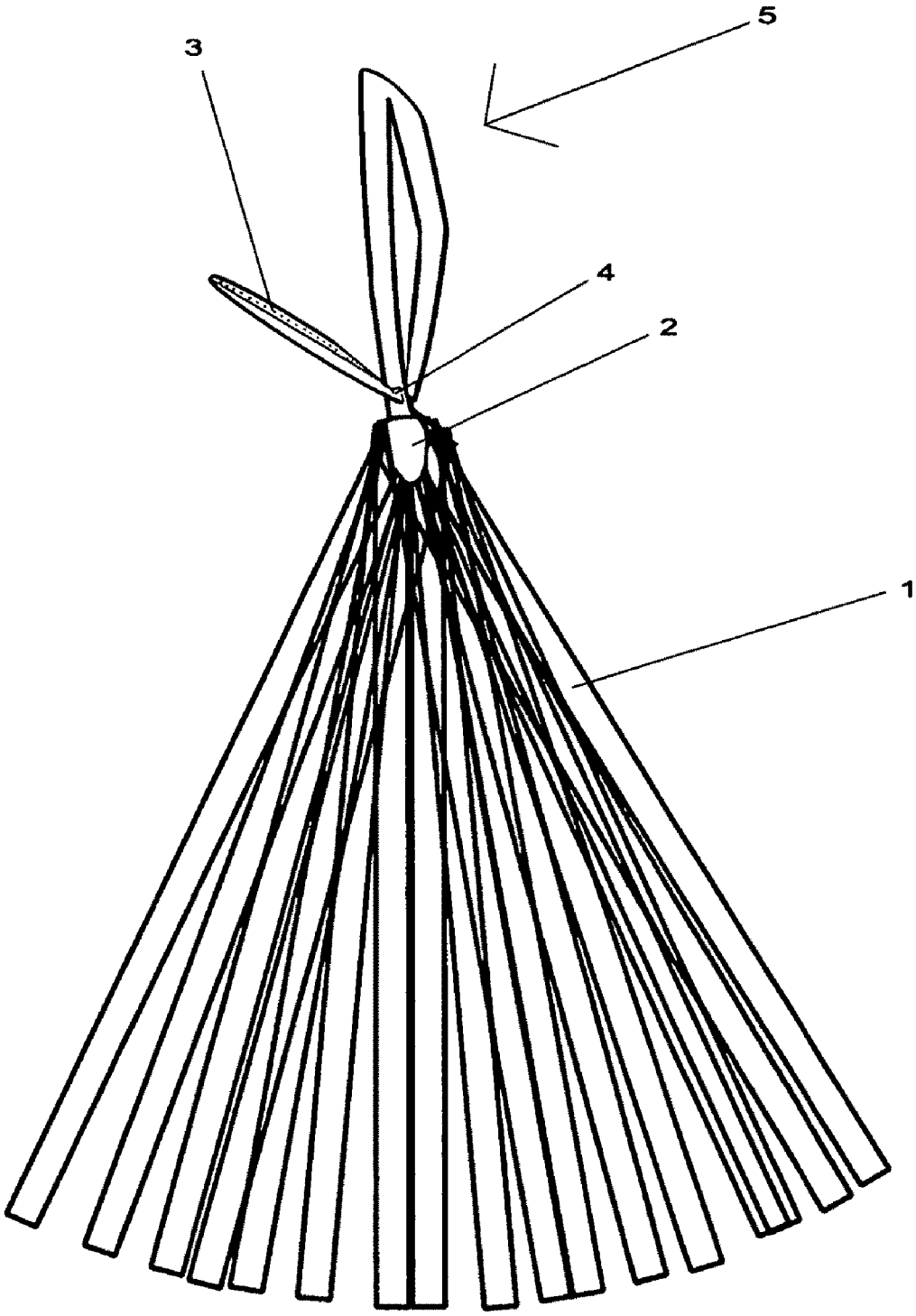
FIG. 2 depicts the pom pon streamers 1, with the hook 3 and loop 2 fastener as it would appear as it threads-through the opening 4 and creates an adjustable attachment apparatus handle 5 which can be attached to numerous, different sized objects, from a car door handle, to a person's hand.
Figure 3:
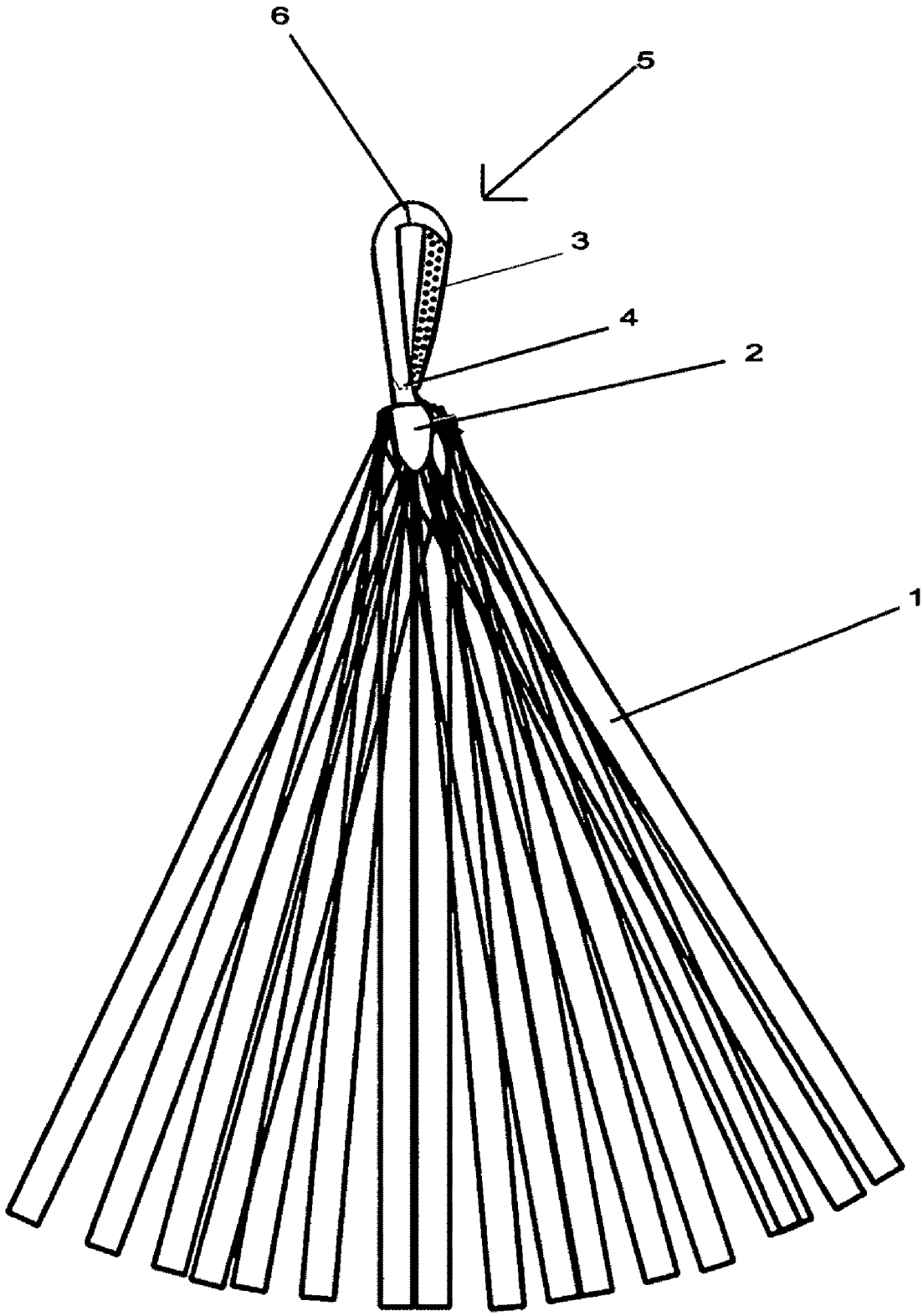
FIG. 3 depicts the pom pon streamers 1 with hook 3 and loop 2 fastener as it would appear in the closed 6 position, after being threaded through the opening 4, with attachment apparatus handle 5.
Figure 4:
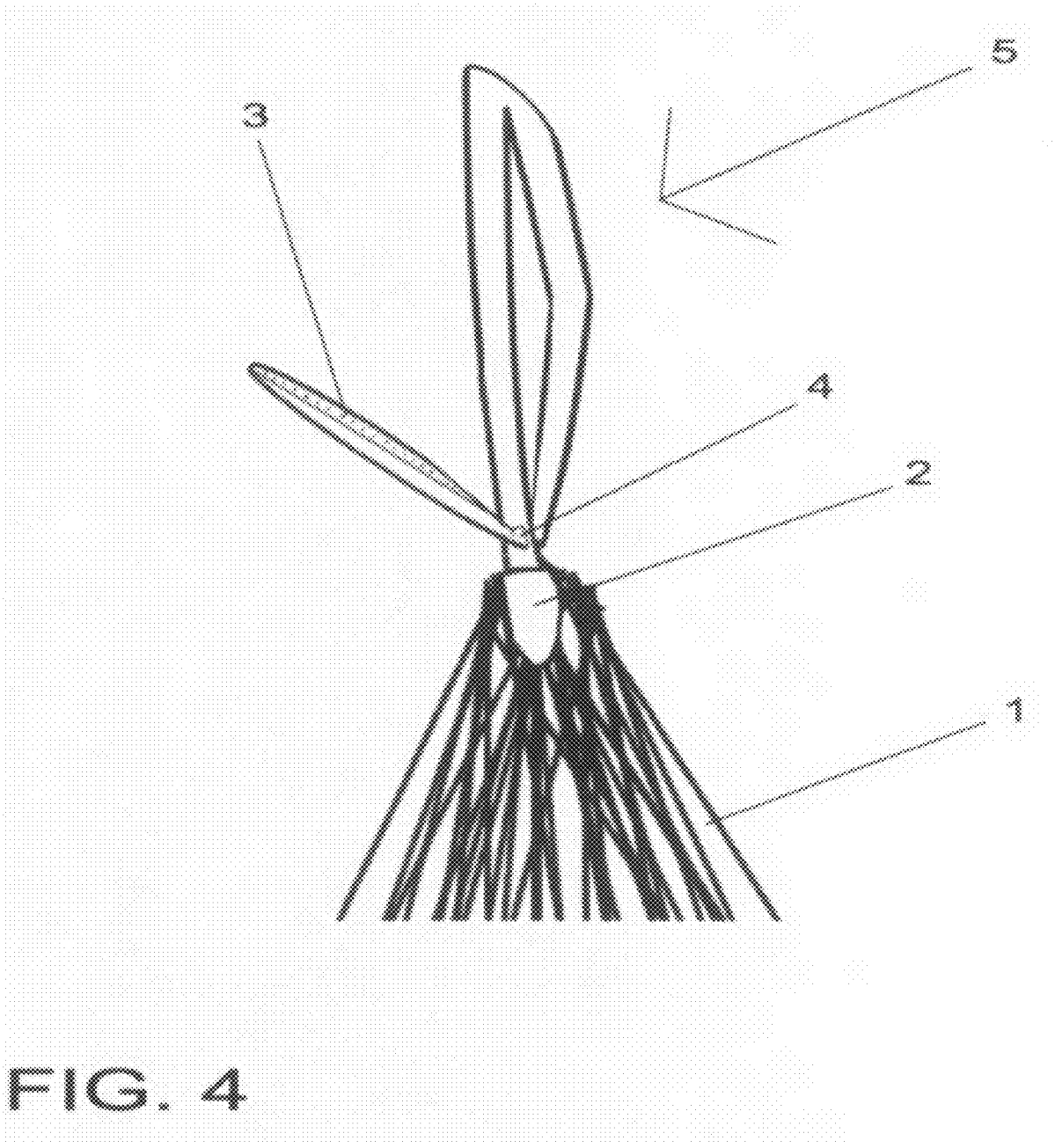
FIG. 4 depicts a close-up view of the pom pon streamer's 1 attachment apparatus/handle 5, as the hook 3 and loop 2 fastener is threaded through the opening 4.
Figure 5:
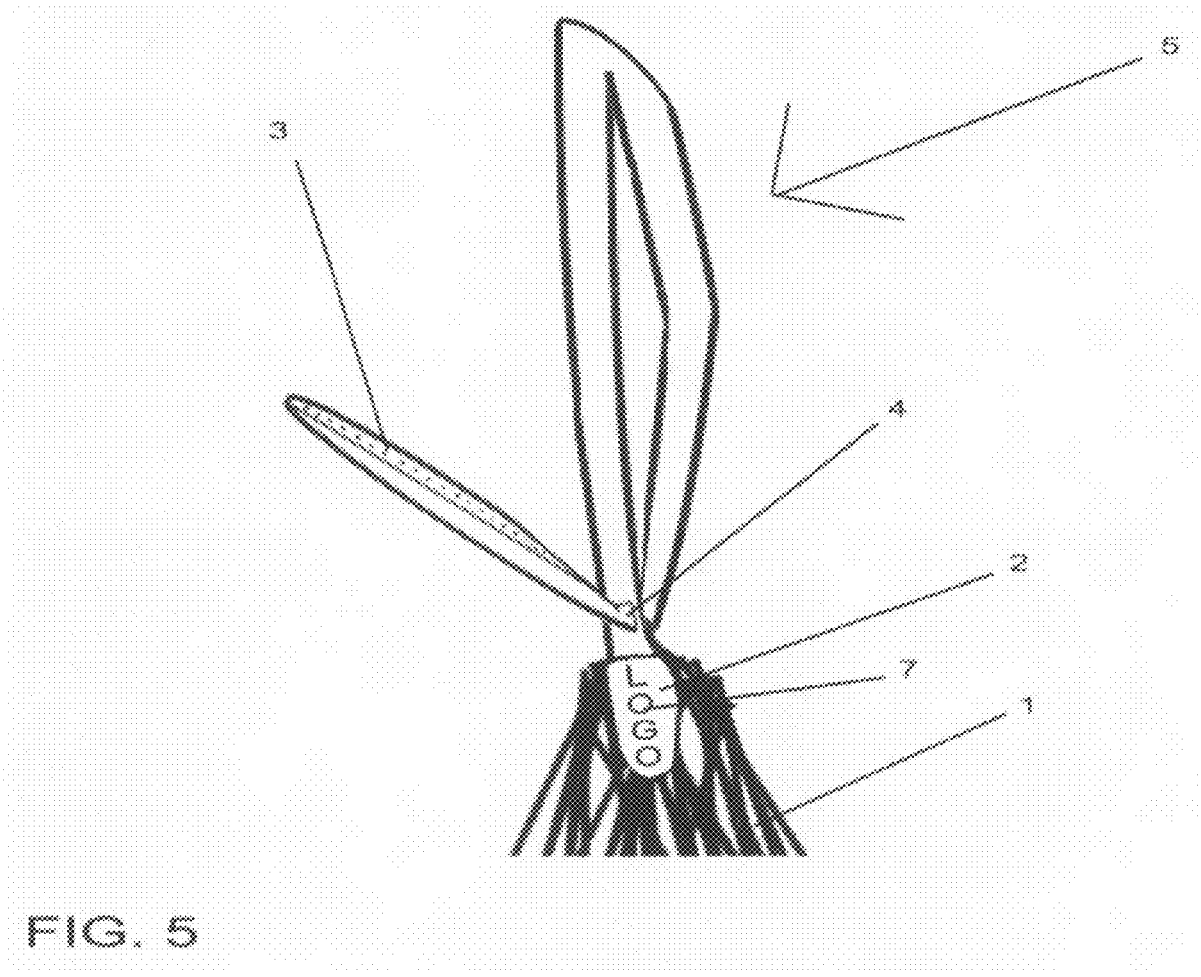
FIG. 5 depicts a close-up view of the pom pon streamer's 1 attachment apparatus/handle 5, as the hook 3 and loop 2 fastener is threaded through the opening 4, with a logo 7 adhered to the loop 2 front side of the present invention, in front of the middle of the gathered streamers 1.
Figure 6:
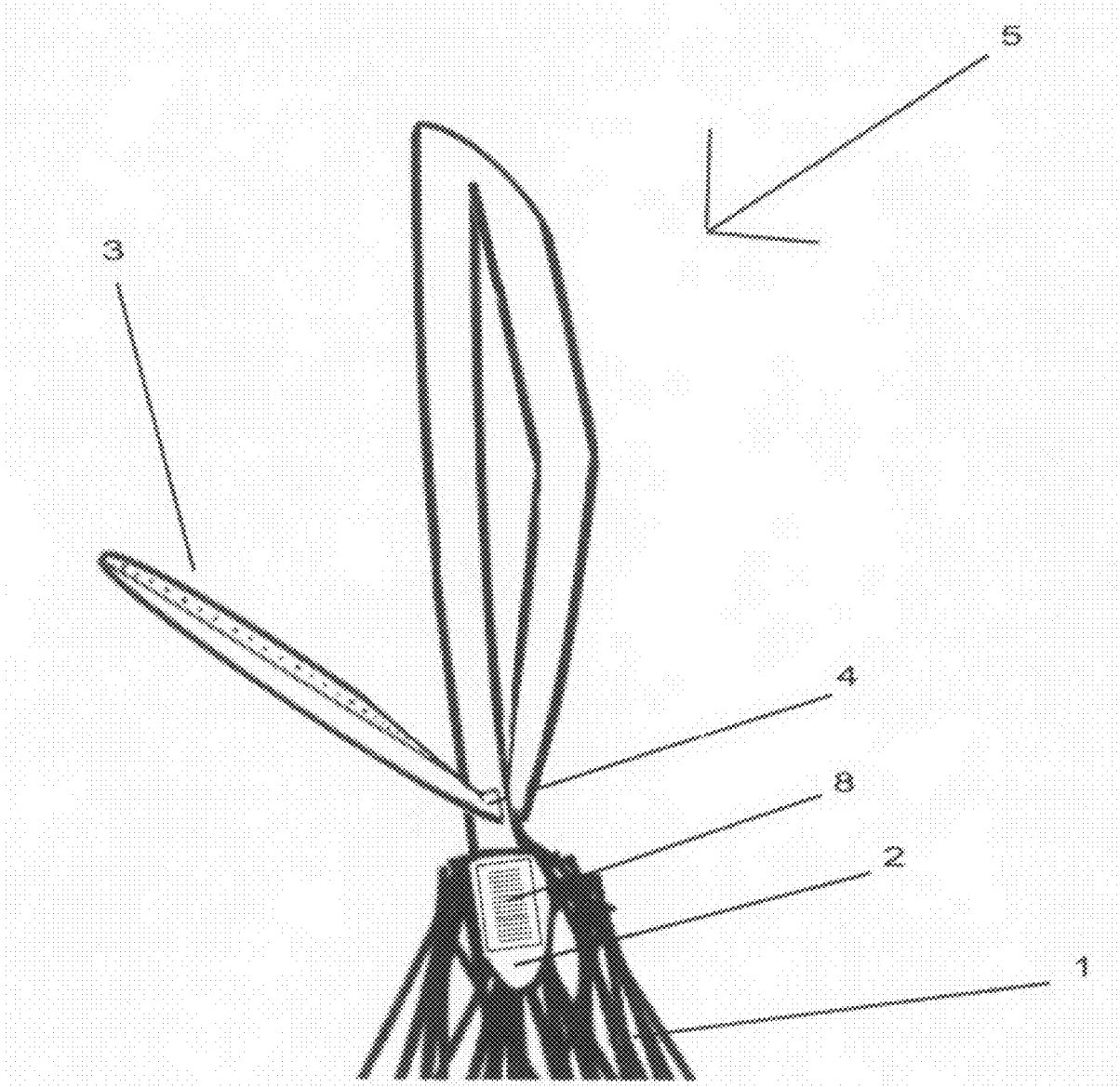
FIG. 6 depicts a close-up view of the pom pon streamer's 1 attachment apparatus/handle 5, as the hook 3 and loop 2 fastener is threaded through the opening 4, with a sound box/device 8 adhered to the loop 2 front side of the present invention, in front of the middle of the gathered streamers 1.
Figure 7:
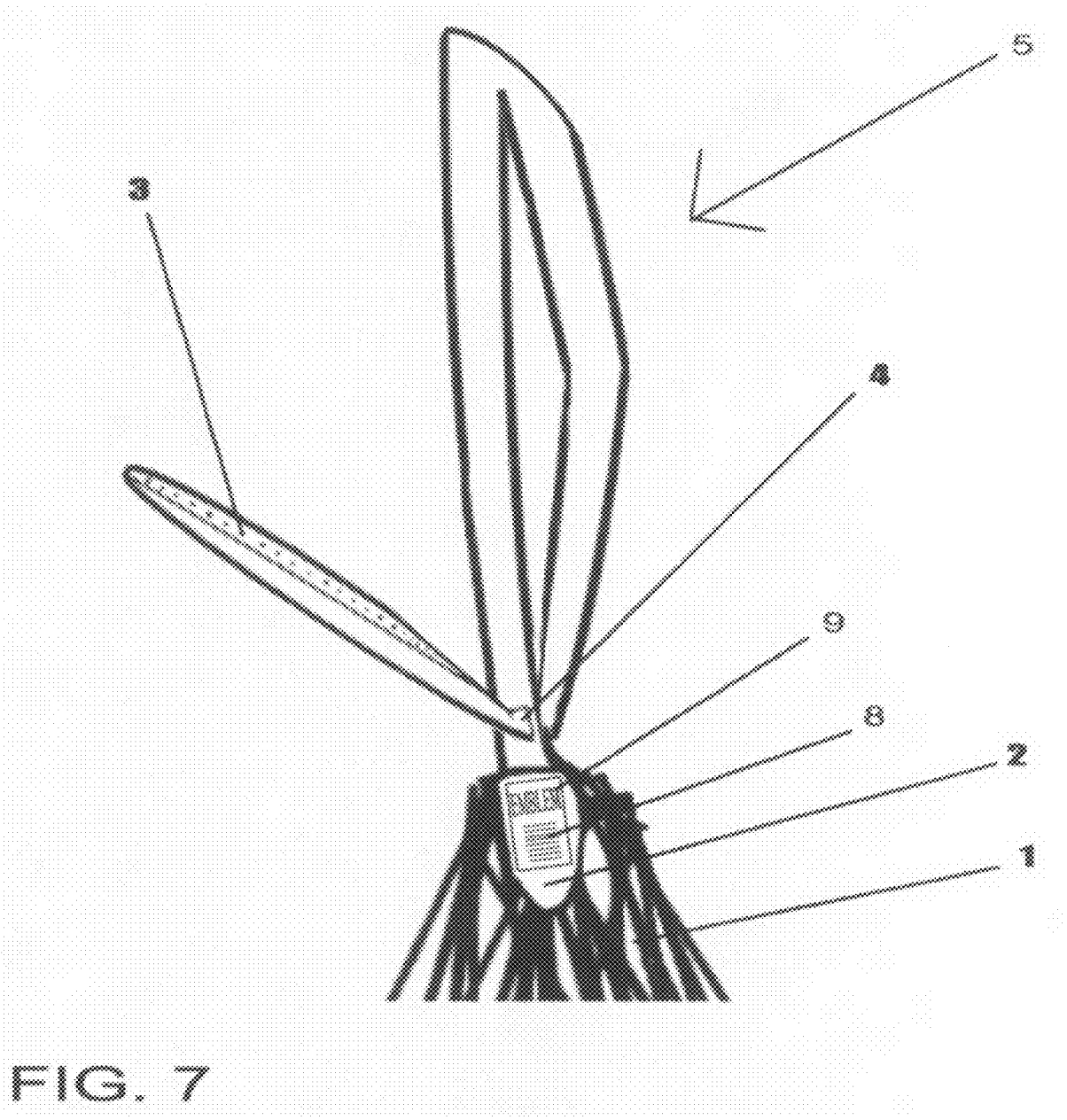
FIG. 7 depicts a close-up view of the pom pon streamer's 1 attachment apparatus/handle 5, as the hook 3 and loop 2 fastener is threaded through the opening 4, with a sound box/device 8 with emblem 9, adhered to the loop 2 front side of the present invention, in front of the middle of the gathered streamers 1.
Figure 8:
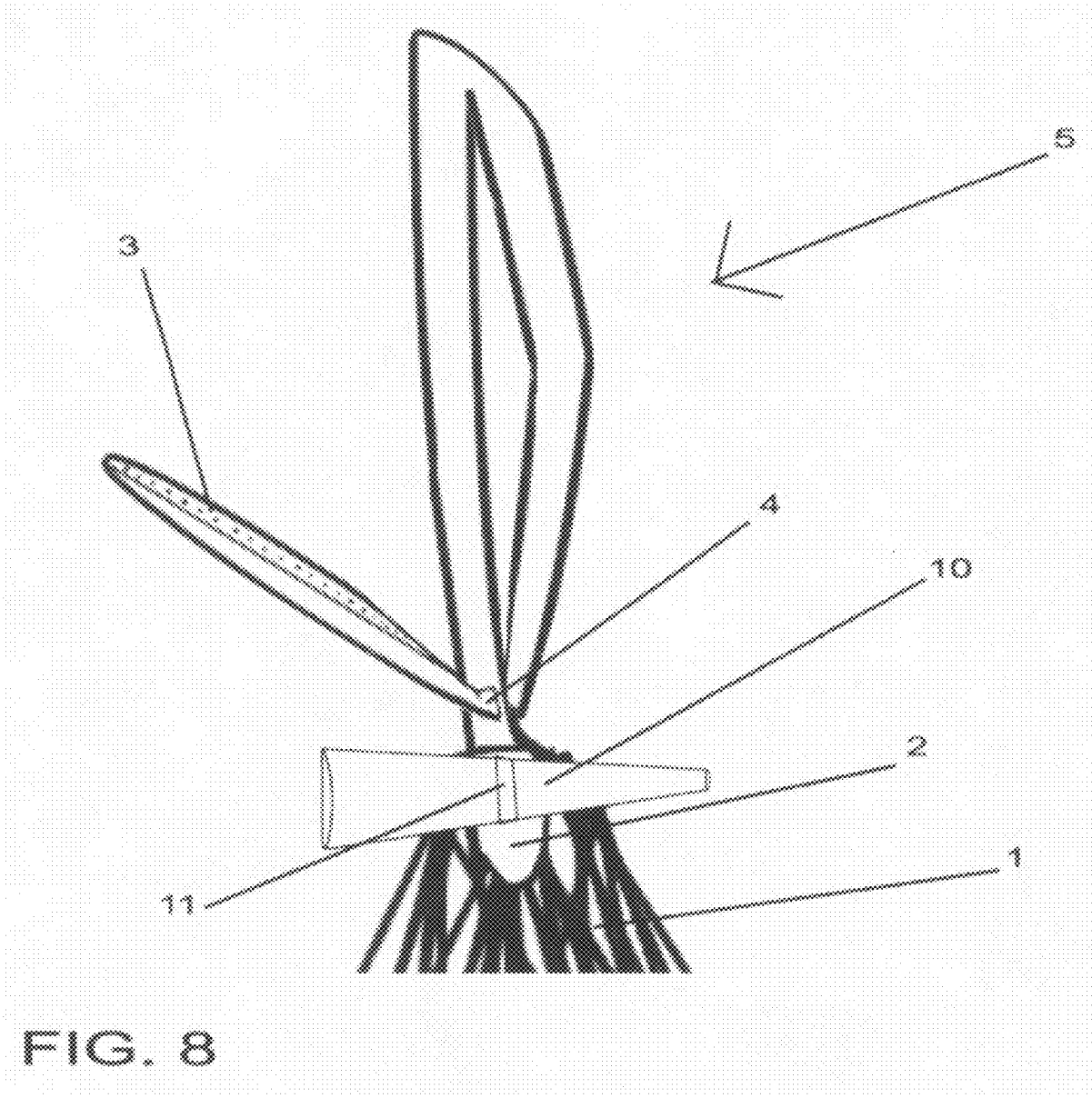
FIG. 8 depicts a close-up view of the pom pon streamer's 1 attachment apparatus/handle 5, as the hook 3 and loop 2 fastener is threaded through the opening 4, with a horn 10 sound device adhered to the loop 2 front side of the present invention, in front of the middle of the gathered streamers 1. The horn 10 in this depiction shows the horn attached from the outside of the horn to the fastener with a strip 11 of material.
Figure 9:
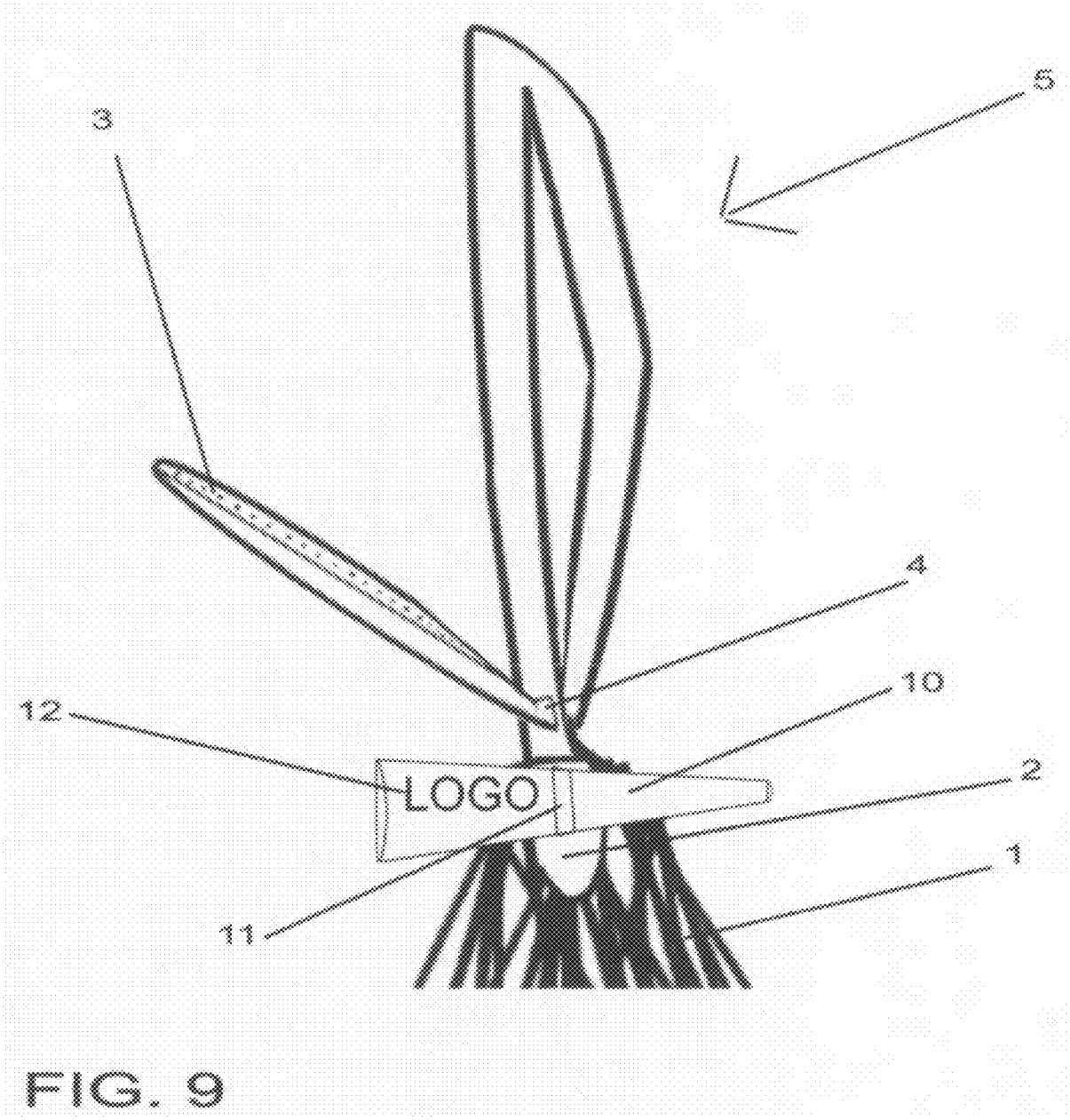
FIG. 9 depicts a close-up view of the pom pon streamer's 1 attachment apparatus/handle 5, as the hook 3 and loop 2 fastener is threaded through the opening 4, with a horn 10 sound device with logo 12, adhered to the loop 2 front side of the present invention, in front of the middle of the gathered streamers 1. The horn 10 in this depiction shows the horn attached from the outside of the horn to the fastener with a strip 11 of material.
Figure 10:
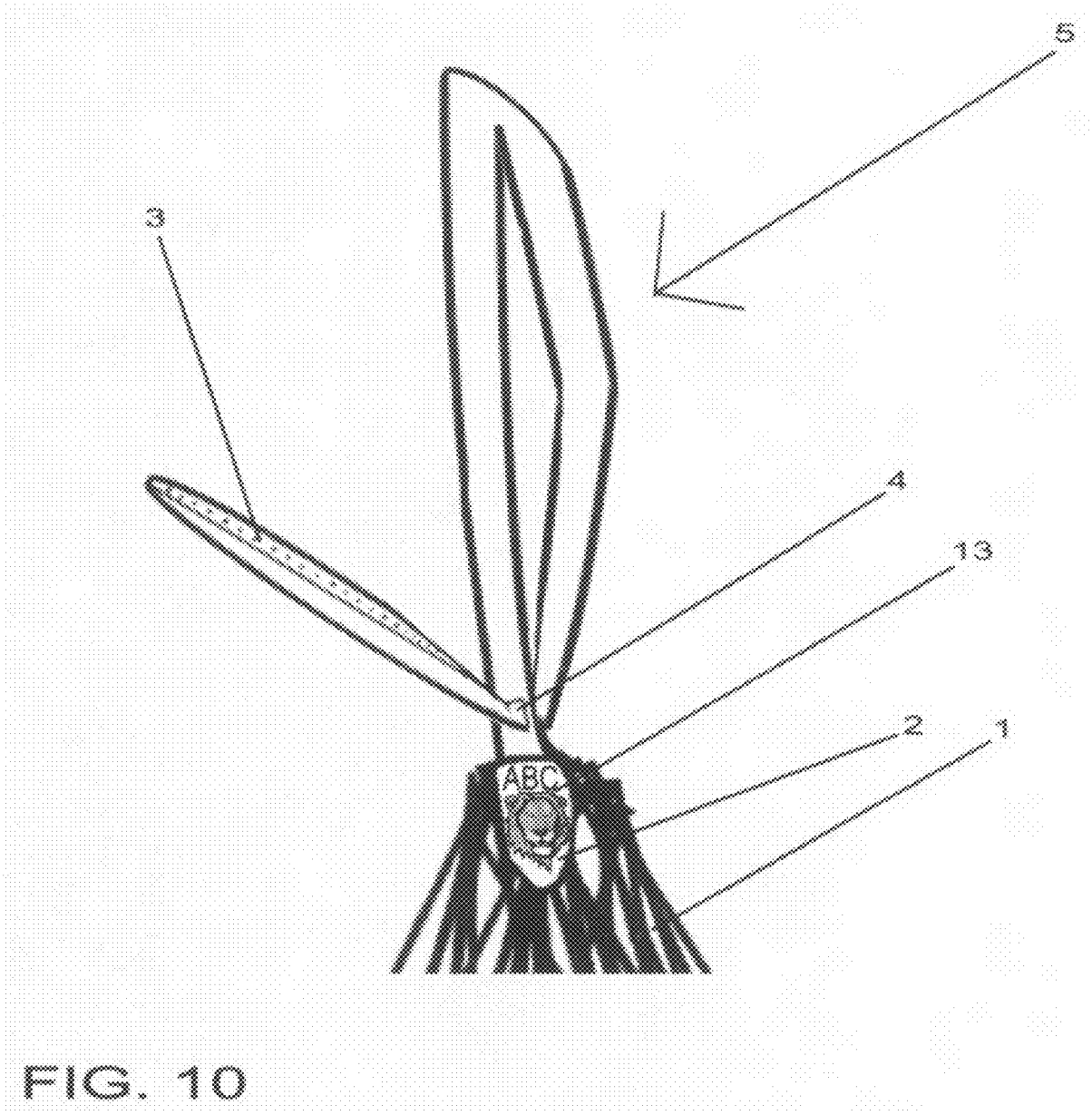
FIG. 10 depicts a close-up view of the pom pon streamer's 1 attachment apparatus/handle 5, as the hook 3 and loop 2 fastener is threaded through the opening 4, with a sample team's mascot 13 adhered to the loop 2 front side of the present invention, in front of the middle of the gathered streamers 1.
Figure 11:
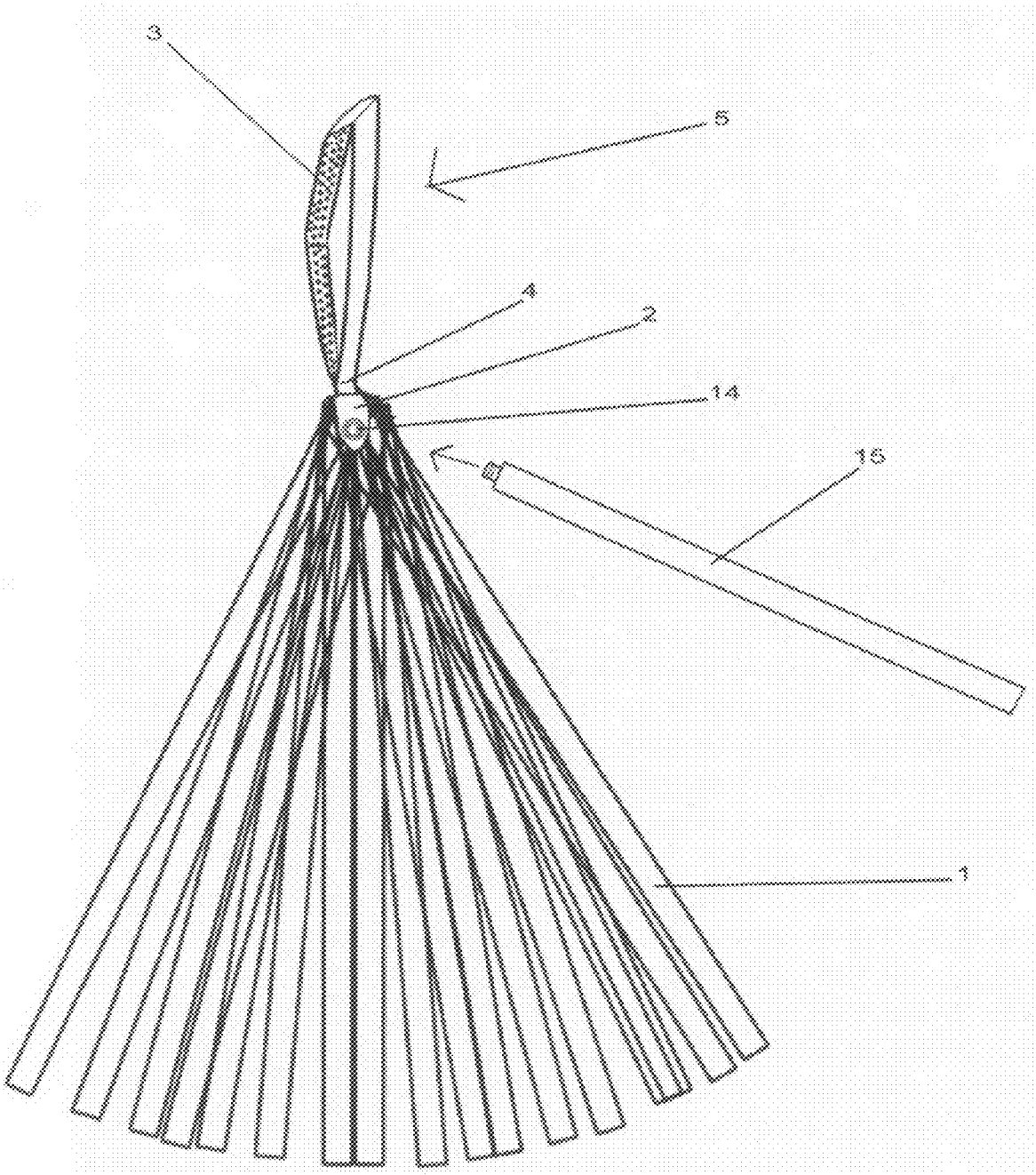
FIG. 11 depicts a close-up view of the backside of the pom pon streamer's 1 attachment apparatus/handle 5, as the hook 3 and loop 2 fastener is threaded through the opening 4 and closed, with a 'female end' type receptacle 14 adhered to the loop 2 back side of the present invention, in back of the middle of the gathered streamers 1, and will receive the 'male end' of a detached handle, rooter stick 15, and/or car window stick attachment.
Figure 12:
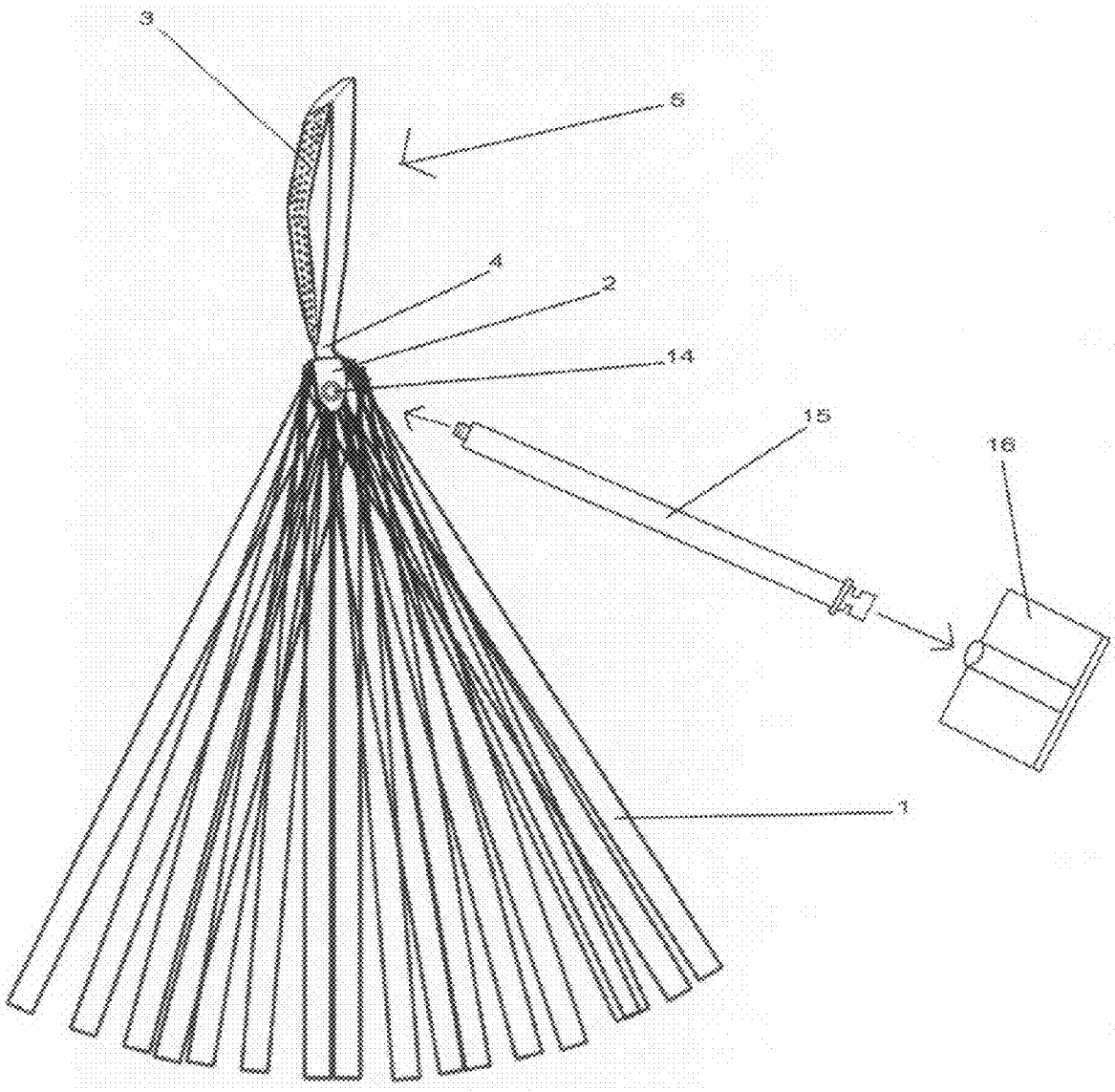
FIG. 12 depicts a close-up view of the backside of the pom pon streamer's 1 attachment apparatus/handle 5, as the hook 3 and loop 2 fastener is threaded through the opening 4 and closed, with a 'female end' type receptacle 14 adhered to the loop 2 back side of the present invention, in back of the middle of the gathered streamers 1, before it receives the 'male end' of a detached handle, rooter stick 15, and/or car window stick attachment 16. (Note: Not shown are various sized handles that may be used in cheerleading, or by fans; width and length of the handle would be dependent upon its intended use. Other handles would be attached to the present invention in the same manner as the rooter stick 15.)
Figure 13:
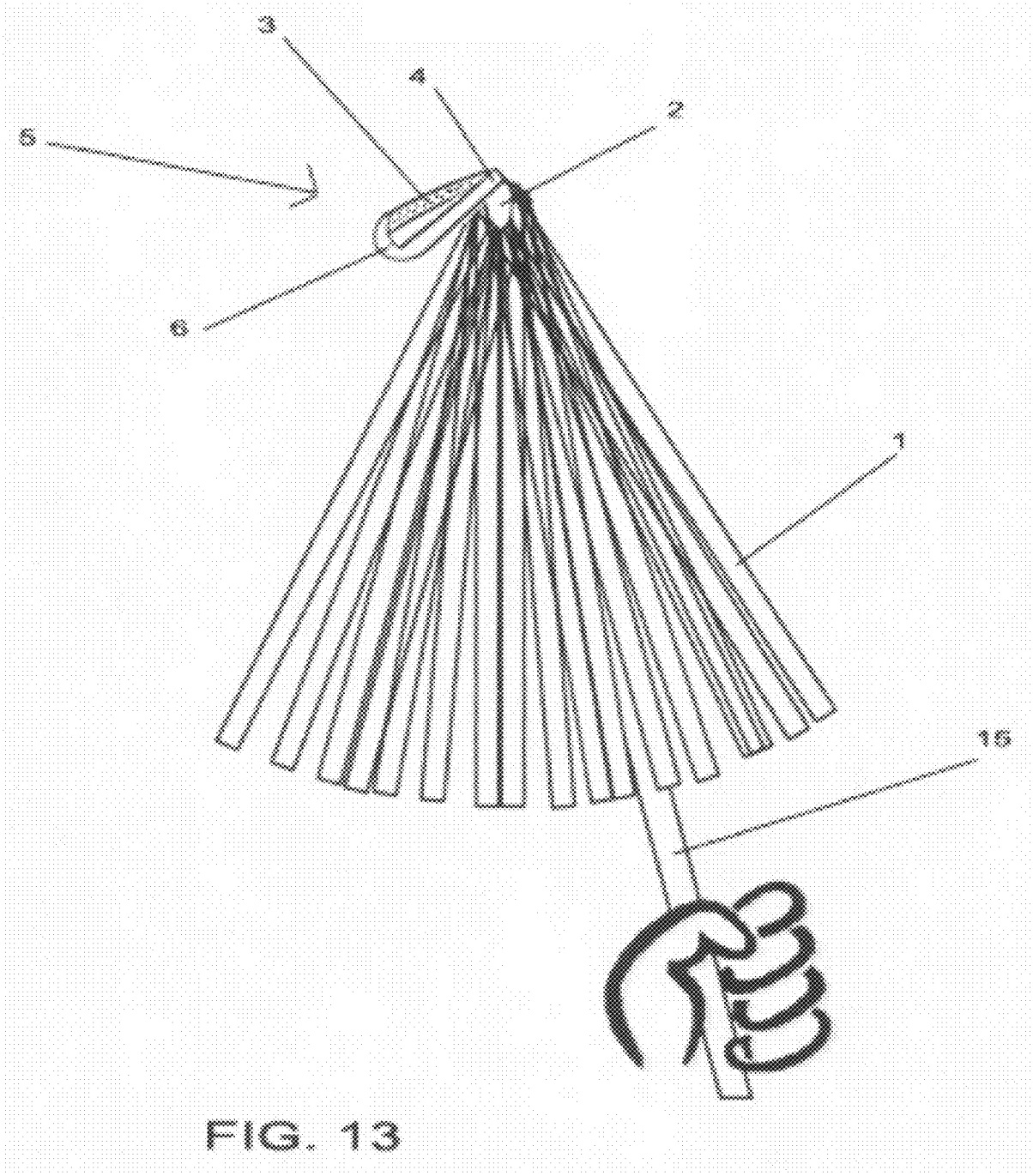
FIG. 13 depicts the present invention as it is attached to a 'rooter stick' 15 and waved in the air. Features shown include the pom pon streamers 1 with attachment apparatus/handle 5, hook 3 and loop 2 fastener as it is threaded through the opening 4 and closed 6, with affixed 'rooter stick' 15.
Figure 14:
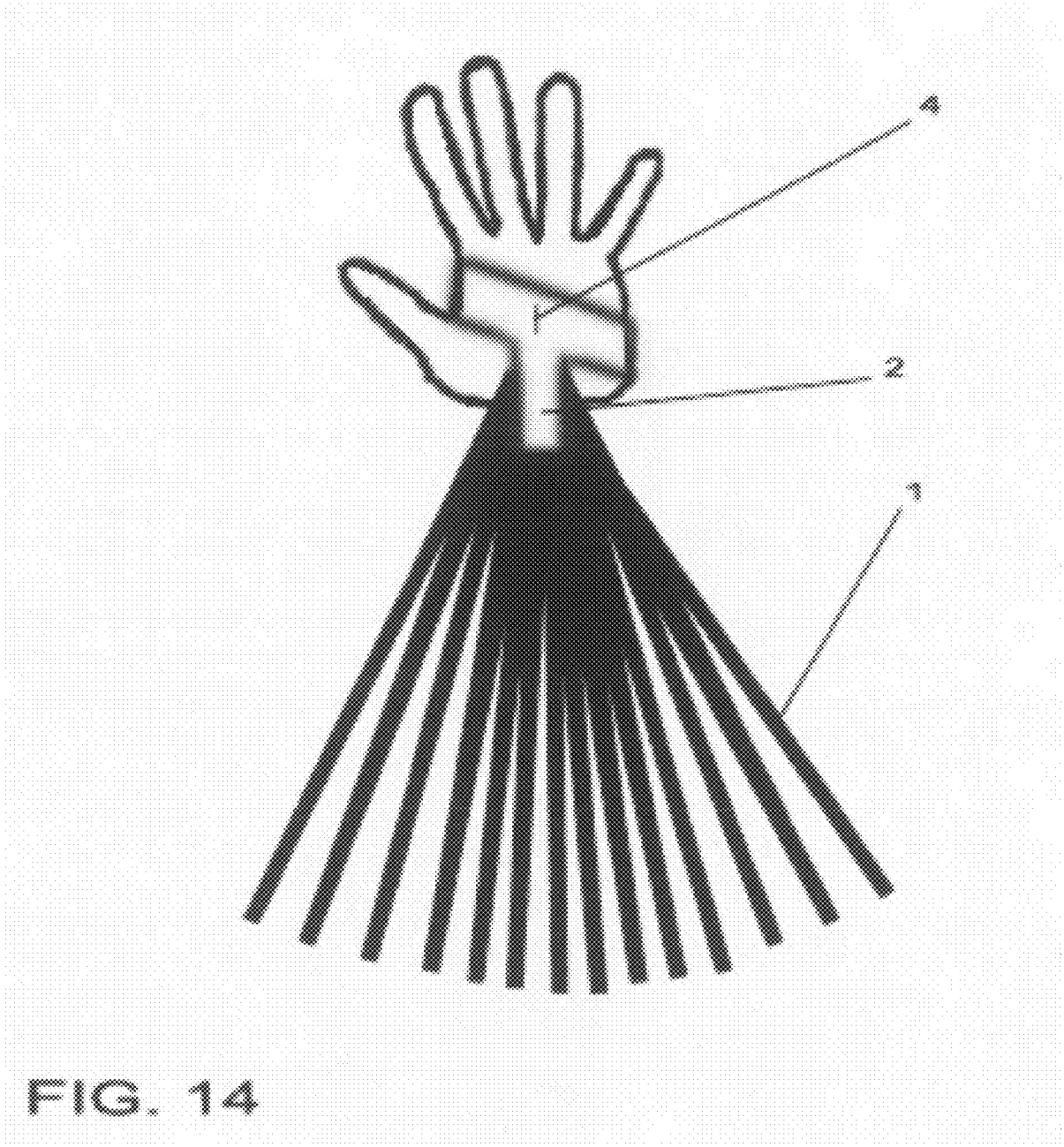
FIG. 14 depicts the present invention with pom pon streamers 1, as it would appear in a hands-free application, with hook 3 and loop 2 fastener attached and adjusted through the opening 4 and closed around a hand.
Figure 15:
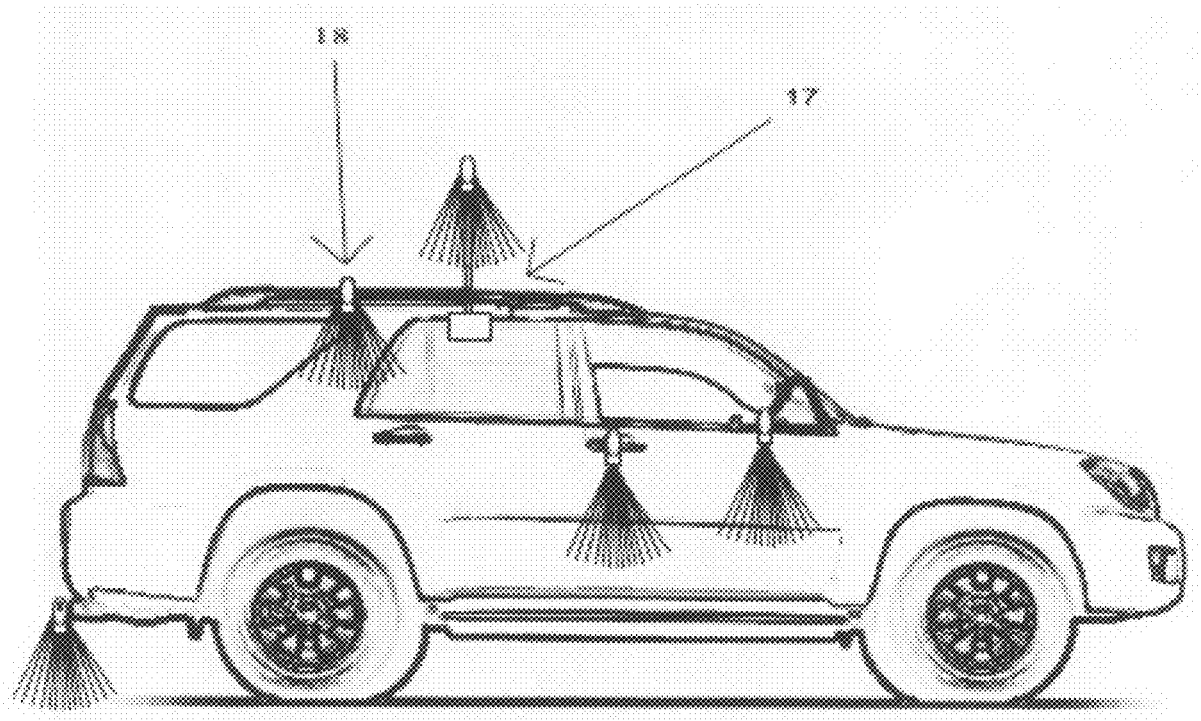
FIG. 15 depicts the present invention 18 as it would appear affixed to various locations on the outside of a vehicle. Included in the drawing is the present invention with car window attachment 17.

Not shown is the use of a telescoping stick. One skilled in the art should understand the principle of such an application as it is used in the present invention, and is attached to the present invention in similar fashion as the 'rooter stick'.

DETAILED DESCRIPTION OF THE INVENTION

The present invention discloses a multi-faceted Pom Pon that may be utilized and manipulated in many ways, and used in different capacities such as, but not limited to, a display on the outside of a vehicle, and/or an entertainment device while at a sporting event, by either cheerleaders or fans. The preferred embodiment of the invention is also machine washable. The present invention discloses a securely attached open-ended fastener that is adjustable, portable, with 'hands-free' potential. The present invention also includes a handle option with multi-capable use, such as car window attachment, or a shorter handle to be used by cheerleaders, or a longer handle to be used by fans (one skilled in the art will know this is referred to as a 'rooter' pom). The present invention discloses a pom pon with sound applications, light illuminating system, decorative applications, and advertising and promotional capabilities. The pom pon's unique fastener and one-piece design allows it to be attached to various sized objects, without any concern of it becoming detached from the object, or the pom pon itself.

The object of the present invention is primarily to provide a durable, self-securing, adjustable, one-piece pom pon (often spelled, 'pom pom') with secured, open-ended fastening capability. Another object of the present invention is to show the diversity of its design, and how it may be used in numerous situations and applications. The present invention's novel construction allows the pom pon to be fastened in various locations not typically used currently, such as on vehicles, and can withstand extreme conditions such as wind, rain, heat, and cold. The present invention's novel construction also will be an advantage when applied to the typical cheerleading tool used on the market today.

The present invention offers a novel idea in the area of visual display for support of a particular sports team, corporation or company, political affiliation and the like, or for any color-identifying entity, for entertainment and brand-building purposes. Common forms of display include the use of pom-pons, typically used by fans, affiliates, at rallies, tailgating parties, by cheerleaders, dance squads, and the like. Lacking in prior art is the ability to place and secure a pom pon on the exterior of a transportation vehicle. Often event-goers will project half of their plastic pom pon outside of a vehicle window, and then close the window on the middle of the pom pon, so that half of it remains inside the vehicle, and the pom pon will not fly away as the vehicle travels down a road or interstate. There is a need in the art to have a pom pon that may be displayed in its entirety on the outside of the vehicle. The advantage of the present invention is that it not only fulfills this need, but also incorporates different techniques to create a truly portable pom pon.

Typical pom pons are constructed of plastic, are not very durable, can tear easily, and do not 'weather' well in hot locations (ie., car, gym bag); repeated exposure to elements such as heat and moisture (ie., sun, rain, sweat) can melt or soil and permanently damage a typical pom pon. A typical pom pon is hand-held, and either does not have a fastener for the hand (or other body part) at all, or it may have a fastener that is not open-ended, adjustable, self-securing, reliably or securely attached to the pom pon, or hands-free; other types of pom pon handles on the market today include an attached closed loop that is placed around a user's hand, such as by a string, or elastic band; a current patent application shows the use of a hook and loop fastener to be removably placed around a pom pon to secure it to an object, but it's use is mostly for clothing display purposes, and not specifically intended for cheerleading, which is a more rugged and taxing use of a pom pon. The inventor's objective in this particular prior art instance is to create a means to allow a user to remove, replace, and use different pom pons when so desired, via the use of a non-permanently attached hook and loop strip. The prior art's intent is functional when applied as clothing adornment, but not practical for a typical cheerleading/fan or vehicle placement use and condition. The prior art does not permit a solid attachment application of the fastener to the pom pom which is needed in situations that require more rugged and repetitive-movement, which is one objective and a necessity for the present invention. The prior art shows a removable strip of hook and loop fastener placed around the pom pon to secure it to an object; the present invention uses a fastener whereas the fastener, and not the pom pon, is secured around an object. The present invention's one-piece design has a fastener fixedly secured to the gather of pom pon streamers. A solid attachment application is needed in the present invention to allow the pom pon to withstand high winds or rain while attached on a vehicle, boat or plane, for example, as it would travel on an interstate, across water, or through the air. A solid attachment is also needed to withstand the repetitive use as it is continuously waved and shaken by a cheerleader or fan at an event. The present invention is a one-piece, self-supporting structure that is of durable construction, and may be securely fastened to objects such as vehicle outside mirrors, door handles, luggage racks, bumpers, tow-hitches, airplanes, boats, and the like, as well as a cheerleader or fan's hand, or any other body part.

The unique structure of the solid attachment in the present invention, in regard to its construction and design of the fastener to pom pon application as described above, is novel because its utility, functionality, purpose, is also to create a space where an item can be attached to either the front or back of where the one-piece fastener is attached around the middle of the gathered streamers. This will be disclosed in more detail below, however, the creation of this space allows for the addition/adherence of any advertising/promotional emblem, sound or light application, rooter stick, car window attachment, magnet, or any various sized handles, etc., and the like to become a part of the present invention. Because the fastener is securely adhered to the middle of the streamers, any item that is adhered to it is assured to stay in place, without worry that the item, and/or the fastener, will migrate left to right, or up and down, from the middle gather of the streamers.

In a preferred embodiment, the streamers in the pom pon are constructed of polyester (fabric) ribbon material, which are manufactured by companies like Offray, and come in a variety of different colors and shades. This type of material is durable, washable, fade resistant, and can be in contact with the surface of transportation vehicles without melting, unlike a traditional plastic pom pon. Other types of material may be used to maintain the desired effect, yet remain in the scope and spirit of the invention. Materials that include solid colors, metallic colors, mirrored, fluorescent, light-catching or reflecting, sequined, and the like, may be used.

Similar to traditional plastic pom pons, the streamers are gathered in the middle of their lengths, and then secured to keep them from straying; various techniques are used to keep the streamers adhered, such as heat-sealed, glued, metal clip, and the like. One skilled in the art will understand the typical construction of a plastic cheerleading pom pon. One end of an open-ended adjustable fastener is then securely attached completely around the entire middle gathering of streamers. The fastener may be glued, stapled, sewed, heat-sealed or the like, to durably and reliably secure it to the gathered middle of the streamers, and fixedly hold it in place so the present invention may be used in a variety of conditions, from typical to extreme. The pom pon in the preferred embodiment is non-removable. One skilled in the art will understand there may be many ways to accomplish the desired task, with different materials or tools now available, or for those that may become available in the future.

A less preferred embodiment would be to have the open ended adjustable fastener securely attached at one end to a crimped metal clip or ring that is encompassed and secured around the middle of the gathered streamers to keep them from straying or migrating. A band of material may be placed around the middle of the gathered streamers in this embodiment, on top of the metal clip or ring, to incorporate the function of adding items to it, as mentioned briefly above, and described in more detail below. A portion of the metal clip or ring would be exposed from the band of material at the top to allow the secured attachment of the open-ended fastener.

The preferred embodiment for the fastener in the present invention is the use of a single hook and loop fastening strip, with the hook side of the fastener on one side of the single strip, and the loop side on the other. An advantage of this type of fastener is that the material is bendable and flexible, and the length can be easily shortened by a cut with fabric scissors, if desired. In the preferred embodiment, one end of the fastening strip is securely attached around the middle gathering of streamers, with the hook side facing the streamers. The strip is approximately ¾ inch wide and 20 inches long, although it may be offered in varying widths and lengths, and still remain within the scope and spirit of the present invention. The hook and loop fastening strip contains a small opening about an inch above where the fastener is secured to the gathering of streamers, i.e., pom pon strands/streamers. The Velcro Brand company currently offers a new, similar strip for sale on the market today. The second end of the fastening strip is then threaded through and placed through the opening, and can fasten back upon itself. Because of the nature of this type of strip, with hook and loop on opposing sides, and because of the unique opening placed in the middle of the fastening strip, the pom pon may be adjusted to fit around most any object, large and small. Because of the nature of hook and loop closures, and depending on how long the strip is, and how big or small the desired object is, the fastening strip may be threaded through the opening and wrapped around an object a number of times until it is tight and secure; this allows the pom pon to be attached to a variety of sized-objects, from wide-based side vehicle mirrors, to a small ball tow-hitch, or to any sized hand, limb, or even forehead, for example. The manufacturing of the length of the fastening strip may vary, just as the length and size of the pom pon streamers may vary, and still remain in the scope and spirit of the invention. Because of the secured and durable connection of the affixed fastening strip to the streamers, the consumer can be assured that the pom pon will be stable and safe, and not come apart or move off of center during whatever application they use it for, whether it be from vibration or wind while attached to a vehicle or even a speeding boat, or from repetitive cheerleading and/or fan use. Another advantage of the present invention is that it is portable; once a fan arrives at an event, the pom pon may be removed from their transportation vehicle by disengaging the hook and loop mechanism, taken into the event, and then used as a entertainment display/fan/cheerleading device, by wrapping it around their hand, limb, or head. At home or at work, the pom pon may also be hung and displayed until again used for another event as it travels down the road to another game or rally. To ensure the polyester ribbon material does not fray, whether when it comes in contact with the hook material on the fastener, or by excessive wind as it travels down the road or on the water, a sealant, such as glue, wax, clear nail polish, or polyurethane, and the like, is applied to the ends of the ribbon material, approximately ¼ an inch at the tips. Some products offered on the market today to keep ribbon ends from fraying are called, "Fray Stop" and "Fray Block", and "Fray Check". Another technique used to seal a polyester ribbon is to apply heat to the ends to slightly melt the material to keep it from fraying. A less preferred method would be to tie the ends to inhibit fraying.

In another embodiment, the small opening in the fastening strip may be a buckle, with the hook and loop strips permanently attached to each side of the buckle, so as to remain in the scope and spirit of the invention.

In another embodiment, to increase the portability objective of the present invention, and enhance convenience of the pom pon while being used at an event, a 12" plastic stick may be adhered to the present invention and be used as a handle. One skilled in the art will be familiar with the 'rooter pom', which typically contains a long narrow stick handle for ease of use for the fans in the stands to wave their pom pon high above the crowd. The stick can be attached to the present invention by a screw-type mechanism, in which a small part, a receiving receptacle, is attached on the fastener, in the middle of the gathered streamers. The present invention may also have a small female end attached on the fastener, in the middle of the gathered streamers, and the stick would contain the male end so it will 'click' and attach onto the pom pon. Varying sizes, length and widths of 'sticks' or handles may be added to the pom pon, and still remain in the scope and spirit of the invention.

In another embodiment, a car window stick and bracket attachment can be utilized, similar to what is currently known in the market as a 'car flag' window attachment. In this example, a 21" plastic stick is screwed or snapped into the small receiving receptacle on the fastener (as described above), and then the window bracket end of the stick is placed on each side of a car window. When the car window is rolled up, the stick remains in place. The stick is made of unbreakable plastic that can withstand wind as a vehicle with the pom pon travels down a road. Currently offered on the market today, is such a stick with a removable window bracket; when this base is removed, the event-goer can utilize the invention as a hand held stick device, like the 'rooter' pom; this example even further illustrates the portability of the present invention.

In another embodiment, a suction cup can be attached to the present invention and attached to any type of structure that will accept this type of application. The suction cup may be attached to the hook and loop fastener, or to the 'rooter' stick, or any type of handle as described and disclosed above. This allows the present invention to be hung in places where an adjustable fastener or handle will not work, such as a tile wall, or the middle of a car window, or a window in the home, and the like.

Another embodiment is to apply the use of an attachable telescoping stick instead of, or in conjunction with, the types of sticks and handles described above. This allows a person to adjust the present invention to a desired height/length, when, for example, being placed on a car window, being waved with the hand, or being used by a young cheerleader who has a smaller hand than the average adult. This use would also allow the pom pon to grow with a young cheerleader, who may want to use the pom pon as she grows, and could increasingly adjust the length of the stick handle.

In another embodiment, for attachment and increased portability functions, a round 'button' magnet may be adhesively attached to the backside of the fastener where the streamers are gathered, or it may be enclosed inside a fabric encasing and then sewn to the hook and loop fastening strip, in any location, but preferably on the fastening strip behind the gathered streamers. In this embodiment, the present invention becomes portable when the desire is to attach the pom pon to magnetic locations, such as on car bodies, and the like.

The natural advantage of the preferred embodiment of the fabric ribbon streamer pom pon with hook and loop fastener, is that the entire product is washable. It may get soiled from tailgating parties, or dirty from the interstate, or wet with rain, and the like, but can be easily cleaned, and will not fall apart in the washing machine. Another advantage of the preferred embodiment, is that it is fade resistant and will have longevity to display colors vibrantly, over a long period of time, and offer the consumer long use of the present invention. Another advantage of the present invention is that its one-piece design conveniently adjusts securely around any object found in the home, at work, at school, tailgates, rallies or games, or on the body . . . anywhere one wants to display team spirit.

In other embodiments, one skilled in the art will understand that different types of open-ended fastening strips may be used to accomplish the same task and remain in the scope and spirit of the invention. Other types of fasteners may include a strip with snaps or hooks, a belt-like strip, a strip made of ribbon with hook and loop attached in various locations, a strip with a clasp, or any strips made with any notions that are sold at sewing and craft centers to be used in the construction of an adjustable strip, such as used in clothing or belts or ropes, whether in consumer or industrial use, or any open-ended fasteners that may be made of future materials that are not currently known. The present invention may include an open-ended fastener with locking capabilities, such as key or combination, for example, to allow the preferred embodiment of the present invention to be protected from theft while placed on a vehicle or the like; one example of this would be plastic enclosed chain or cable lock for a bicycle.

One skilled in the art will understand that the present invention may offer varying widths of streamers, varying lengths of streamers, and varying number of streamers, depending on the type of application for the pom pon, to remain in the scope and spirit of the invention. A decorative element, such as a bow or team mascot (made of fabric, plastic, and the like) or corporate logo, etc., may be attached for aesthetic or brand/team identifying purposes to the fastener, in the middle where the pom pon streamers are gathered.

In another embodiment, the principle idea of the present invention can be used in the construction of today's typical plastic pom pons. There remains a need to have a convenient, hands-free, reliably secured, open-ended, adjustable fastener on a pom pon, all in a one piece construction, which the present invention offers. A pom pon receives repetitive force by a cheerleader, and when there is no handle present, it needs a fastener that reliably secures to the streamers so they do not move or migrate from the center while in use. Another need is to have a secure means to wrap the fastener around the cheerleader's hand, but one that is adjustable, since cheerleaders are of all ages and sizes. With the durably secured fastener to streamer application of the one-piece construction of the present invention, these needs are fulfilled; a cheerleader may wrap the fastener around her hand with confidence to know the streamers will remain in place and in the desired appearance. Fans who use a typical plastic pom pon, or 'rooter' pom, whether on their hands, wrist, leg, or any other body part, will also be assured that the present invention will securely hold the streamers in place, even with repetitive use. In another embodiment where a different type of handle is used, such as those currently manufactured and on the market today for the application of competition cheerleading use, etc., the present invention may be incorporated by attaching handles of various widths, lengths, and configurations, by screwing them on, or snapping them in place, for example, to the receptacle on the fastener, as described above, in regard to attaching 'sticks'; this application would add yet another facet of stability for the user. One skilled in the art will recognize that there are varying ways to attach a stick handle to an object; one will recognize that more designs may become available in the future, and may be used in this application, as long as it remains in the scope and spirit of the present invention.

In another embodiment, the present invention may consist of pom pon streamers made of various materials such as plastic, polyester ribbon, paper, fabric, fiber optic strands, etc.—materials now known, or those that become available in the future. The present invention may also include streamers with light illuminating capabilities, such as when activated by heat, or by adding light reflectors (such as bike reflectors), and the like, or by some other means now known, or to be discovered in the future; another example of illumination includes a liquid composition that glows inside a structure, once activated by breaking it in half, such as a 'glow stick' currently on the market today, or something similar to novelty items with fiber optics, yet would not need to be plugged into an electrical outlet, but would be self producing (battery operated and/or photovoltaic, for example).

The present invention may also include the configuration of the addition of sound effects that the streamers either make themselves while blowing in the wind, or while shaken by a cheerleader or fan, or with the adherence of an audio-making device to the streamers, or with the attachment of a sound apparatus, such as a small battery operated sound box affixed in the middle where the fastener and streamers meet. Current technologies, such as iPods, Mp3 players, for example, may also be used for the desired effect and application. The streamers themselves may apply self-conducting sound affects, such as a whistling sound, when the wind blows on them with the present invention placed on a transportation vehicle, for example. A sound box/device with audio enclosure capability may project an audio version of a team cheer, spoken motto, an anthem, or song, and the like. Another embodiment of an attached sound apparatus may include a blow horn commonly used at sporting events, or a whistle, noisemaker, and the like.

The items mentioned above, ie., light, sound, mascot toy, etc., may be removably attached, and interchangeable, to allow the user the option to connect a horn, for example, to the present invention, or a sound box, or a toy replica of a mascot, etc. These items could also be sold separately as permanently attached items to the present invention.

The present invention may be manufactured with all attributes incorporated, as mentioned above, in whole, or in part; from construction of a typical plastic pom pon with the addition of the present invention's secured, adjustable, open-ended fastener, to the present invention's embodiment of a pom pon with ribbon streamers and secured, adjustable, open-ended fastener, to one with light illuminating qualities, or one with light illuminating qualities and sound/audio capabilities, whether from the streamers themselves, or with a sound box/device or horn, or with any of the combined applications as discussed and disclosed in the present invention above.

The present invention also allows for the addition of advertising and promotional possibilities, such as by retail offers (coupons, discount cards, tokens, etc.), and/or with an embedded design of a school, business, or political identifying marker, such as a logo, text, trademark, school letters or mascot, for example, and/or with a photographic image, 3D visual, or futuristic display, such as a holograph, and/or hologram. Locations for these additions are available on the streamers themselves, on the open-ended fastener, on a sound box/device or horn, on a decorative element (such as a bow or mascot), or on any type of handle, or window attachment, as described above. Retail offers may simply be attached and hung by a plastic tie that is placed through or around any attribute of the present invention. Embedded emblems or designs for advertising and promotional display purposes may include a school, company, political motto, and the like, such as a logo, identifying colors, letters, abbreviations, acronyms, etc, and may be adhered to the present invention in different manufacturing ways currently offered today, or with advanced technologies in the future to create the same desired effect. The Velcro Company, for example, currently offers such technology.

One possible product name currently being considered is, "Port-O-Pom", to describe the present invention's numerous portability capabilities to cover various situational uses.

The invention claimed is:

1. A pompon that is held stationary within a permanently attached adjustable open-ended fastener;

wherein said pompon is comprised of flexible strand material;

wherein said pompon contains a center-point of said strand material;

wherein said open-ended fastener may adjustably attach to an external object;

wherein said open-ended fastener is comprised of two ends;

wherein one end of said open-ended fastener is fixedly and permanently attached to, fastened and closed around, said center-point of said pompon so as said one end of said open-ended fastener and said strand material of said pompon is in a fixed and stationary position, is non-adjustable, and may not migrate nor move there from said center point;

wherein said open-ended fastener is comprised of a strip of hook and loop material;

wherein said strip of hook and loop material has a top surface and a bottom surface;

wherein said top surface is comprised of loop material;

wherein said bottom surface is comprised of hook material;

wherein said open-ended fastener has an opening within same said open-ended fastener to receive other end of said hook and loop strip of said open-ended fastener;

wherein said other end of said open-ended fastener is open and may be removeably placed around said external object, and then threaded-through said opening in said open-ended fastener, to adjustably attach to said external object as said bottom surface of hook material and said top surface of loop material of said strip of hook and loop material mate and fasten away from said center point to secure said open-ended fastener of said pompon around said external object.

2. A pompon as in claim 1, wherein said open-ended fastener has attachment capabilities to receive an attached rooter stick.

3. A pompon as in claim 1, wherein said open-ended fastener has attachment capabilities to receive an attached telescoping rooter stick.

4. A pompon as in claim 1, wherein said open-ended fastener has attachment capabilities to receive an attached car window stick.

5. A pompon as in claim 1, wherein said open-ended fastener has attachment capabilities to receive an attached handle.

6. A pompon as in claim 1, wherein said open-ended fastener has attachment capabilities to receive a suction cup.

7. A pompon as in claim 1, wherein said open-ended fastener has attachment capabilities to receive a magnet.

8. A pompon as in claim 1, wherein said open-ended fastener has externally applied locking capabilities.

9. A pompon as in claim 1, wherein said open-ended fastener emits illumination, and has attachment capabilities to receive externally applied accouterments such as a sound device, and has photovoltaic producing capabilities.

* * * * *